US008070122B2

(12) United States Patent
Suciu et al.

(10) Patent No.: US 8,070,122 B2
(45) Date of Patent: Dec. 6, 2011

(54) SCISSOR-ACTION SUPPORT ARRANGEMENT

(75) Inventors: Rebecca C. Suciu, Lynn, MA (US); David E. Pitcher, Swampscott, MA (US); Thomas P. Burrous, Haverhill, MA (US); Alan L. Stenfors, Scituate, MA (US); Sidney Rose, Marblehead, MA (US)

(73) Assignee: Rose Displays, Ltd., Salem, MA (US)

( * ) Notice: Subject to any disclaimer, the term of this patent is extended or adjusted under 35 U.S.C. 154(b) by 148 days.

(21) Appl. No.: 12/590,122

(22) Filed: Nov. 3, 2009

(65) Prior Publication Data

US 2011/0101191 A1 May 5, 2011

(51) Int. Cl.
*A47H 1/10* (2006.01)

(52) U.S. Cl. ..... 248/324; 248/317; 248/343; 248/328

(58) Field of Classification Search ..... 160/196.1; 248/274.1, 288.11, 289.11, 291.1, 323, 324; 52/243.1; 16/87 R, 87.8, 87.4 R, 90, 91, 16/93 D, 94 D, 95 D, 97, 102, 103, 104, 105
See application file for complete search history.

(56) References Cited

U.S. PATENT DOCUMENTS 321,554 A * 7/1885 Waterhouse ..... 59/88
3,141,189 A * 7/1964 Fergison ..... 16/105
5,165,647 A * 11/1992 Ribeiro ..... 248/323

* cited by examiner

*Primary Examiner* — Amy Sterling
*Assistant Examiner* — Erin W Smith
(74) *Attorney, Agent, or Firm* — Don Halgren

(57) ABSTRACT

A scissor-action carrier for suspending a sign or other display from an overhead inverted "U" shaped channel support track. The scissor-action carrier comprises an elongated first arm and an elongated second arm pivotally connected to one another at a pivot axis. A rotatable wheel is attached to an upper end of each elongated arm. Wherein the wheels are individually insertable into and removable from the "U" shaped channel. A connector means is arranged at a lower end of each arm to permit support of a sign or other display therefrom when the carrier is inserted within the support track and the connector means of each arm are in respective alignment with one another, wherein the arms are prevented from rotating freely and the wheels are kept inside of the support track when the carrier is supporting a sign or other display.

16 Claims, 10 Drawing Sheets

SCISSOR-ACTION SUPPORT ARRANGEMENT

BACKGROUND OF THE INVENTION

1. Field of the Invention

This invention relates to overhead support mechanisms and more particularly to readily movable, articulatable linkages which are engagable into and from an overhead support channel from which a sign or other display may be hung.

2. Prior Art

The ability to support a display panel from an overhead track and to be able to change that display panel location easily is very commercially desirable. The prior art is replete with examples of overhead supports and associated linkages. One such example is shown in U.S. Pat. No. 6,708,939 to Walker. A wheeled carrier is inserted into an open end of a channel in an elongated track. A hook or chain extending from the wheeled carrier is utilized to support a display panel of there beneath. Unfortunately this carrier arrangement is not installable in that track except from an open end thereof.

It is an object of the present invention to overcome the disadvantages of the prior art.

It is a further object of the present invention to provide a carrier arrangement which may be inserted into the channel of an overhead track at any location there along.

It is yet a further object of the present invention to provide a carrier arrangement which may be readily removed from that channel of an overhead track at any location there along.

It is yet a further object of the present invention to provide a carrier arrangement which may be prevented from removal from a channel of an overhead track when used for support of a sign or other display.

BRIEF SUMMARY OF THE INVENTION

The present invention comprises a scissor-action carrier which is insertable into and removable from an overhead elongated track at any location therein, while the support track is in an overhead orientation. The scissor-action carrier comprises an elongated first arm having an upper end and a lower end, the first arm connected to a "mirror image" elongated second arm having a similar upper end and a lower end. The elongated first arm and the elongated second arm are joined together at a pivot point in each arm, rotatable thereat about a rotation axis.

The elongated first arm and the elongated second arm each have an elongated hanger opening disposed therethrough. The elongated first arm has a first arm wheel rotatively extending from an outer face thereof, at its upper end, and attached thereto by a first wheel axis. The elongated second arm has a second arm wheel rotatively extending from its outer face, at its upper end thereof and attached thereto by a second wheel axis. The first arm wheel has an axis of rotation about its first wheel axis. The second arm wheel has axis of rotation about its second wheel axis. The elongated first arm has a first arm longitudinal axis. The elongated second arm has a second arm longitudinal axis. During its supportive use in the channel of an elongated support track, the axis of rotation of the first wheel axis and the axis of rotation of the second wheel axis are in concentric alignment, and their respective longitudinal axes are parallel.

The elongated support channel comprises an inverted generally "U" shaped extrusion which may have side flanges in one preferred embodiment, or in another embodiment of the track, it may have a further open channel portion for securing the elongated support channel to a ceiling or suspended from an overhead support.

The elongated support channel typically has a downwardly facing slot defined by a pair of opposed "L" shaped flanges. Those "L" shaped flanges define an elongated channel opening of dimension "X". The width of an elongated arm and its associated arm wheel has a dimension "Y". The dimension "Y" has to be less than the dimension X, to permit the wheeled end of the first arm and the second arm to each be (separately) sequentially inserted within and (separately) sequentially removed from the channel of the elongated extrusion.

In order to insert the scissor-action carrier into the channel of an elongated extrusion, the elongated first arm and the elongated second arm have to be rotated with respect to one another about their common rotation axis, so as to permit the width of only one elongated arm to pass through the channel opening X. The rotation of the elongated first arm with respect to the elongated second arm about its rotation axis permits the upper end of each elongated arm to be separately and sequentially inserted and/or removed from the channel of the elongated extrusion.

Upon the insertion of the first arm wheel and the second arm wheel into the channel of the elongated extrusion the elongated first arm and elongated second arm are again rotated about their rotation axis so as to bring the first arm wheel axis and the second arm wheel axis into alignment with one another. Correspondingly, the first arm hanger opening and the second arm hanger opening also come into alignment with one another once the respective first elongated arm's longitudinal axis is in parallel alignment with the second arm's longitudinal axis. The first arm hanger opening and the second arm hanger opening thus present a common (joint) opening for insertion of a hook or the like from which a display panel may be suspended. While a hook or the like is inserted in the opening in the scissor-action carrier, the first arm and the second arm may not be rotated apart, thus insuring that the scissor-action carrier will not be able to be unintentionally removed from the channel of the overhead elongated extrusion until the hook or the like is removed.

It is to be noted that such an insertion process of the scissor-action carrier may take place at any location along the length of the elongated extrusion track. Similarly, the removal of the scissor-action carrier may take place at any location along the length of the extrusion track by reversing the process of the insertion of the scissor-action carrier. That is, the first elongated arm is rotated with respect to the elongated second arm about their common rotation axis so as to separate the co-alignment of the first wheel and the second wheel, so as to minimize the thickness of the scissor-action carrier at its upper end, thus permitting its removal from the elongated track.

The invention thus comprises a carrier for suspending a display from an overhead inverted "U" shaped channel support track, comprising: an elongated first arm and an elongated second arm pivotally connected to one another at a pivot axis in a scissor-like relationship; a rotatable wheel attached to an upper or first end of each elongated arm, wherein each wheel is individually insertable into and removable from the "U" shaped channel; and a connector means arranged a lower end of each arm to permit support of a display therefrom when the connector means and the rotatable wheel of each arm are in respective alignment with one another. The connector means preferably comprises a support-receiving opening on the lower end of each arm. When a support connector is received through both of the openings, the carrier arms are thus locked together and thus prevented from freely rotating in scissor-like motion with respect to one another. The rotatable wheels on the upper end of each arm are in longitudinal alignment with one another when the support-receiving openings are secured/locked in face to face alignment with one another, thus preventing their common removal from the support track. The rotatable wheels on the upper end of each arm are mounted on an independent wheel axis to permit the wheels to be independently movable on the carrier.

The invention also comprises a method of supporting a display from an overhead support channel attached to a ceiling, comprising one or more of the following steps: inserting an upper wheeled end of a first arm of scissor-action carrier into a slot of the overhead support channel; inserting an upper wheeled end of a second arm of a scissor-action carrier into the slot of the overhead support channel; pivoting the first arm and the second arm of the scissor-action carrier into parallel alignment with one another, for wheeled engagement of the scissor-action within the overhead support channel; and attaching a display to the lower end of the aligned arms of the scissor-action carrier; locking the first arm and the second arm into parallel alignment with one another when a display is supported from the lower end of the arms.

The invention also comprises a method of supporting a display from an overhead support channel attached to a ceiling, comprising one or more of the following: pivoting a pair of scissor-like connected arms out of parallel relationship with one another into a skewed non-parallel relationship with one another; individually inserting a wheel arranged on an upper end of each of the arms, into the overhead support channel; pivoting the connected arms into a parallel relationship with one another; and attaching a display support to a lower end of the arm to prevent the arms from rotating and prevent their removal from the overhead support channel; forming an opening in the lower end of each of the arms to permit insertion of the display support through both lower end of the arms; removing the display support from the openings in the lower end of each arm to permit the arms to be rotated out of parallel alignment with one another, thus permitting the connected arms to be removed from the overhead channel.

BRIEF DESCRIPTION OF THE DRAWINGS

The objects and advantages of the present invention will become more apparent, when viewed in conjunction with the following drawings, in which.

DETAILED DESCRIPTION OF THE PREFERRED EMBODIMENTS

Figure 1:
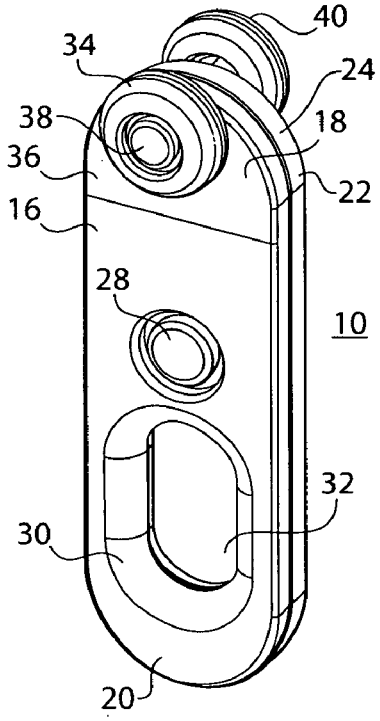
FIG. 1 is a perspective view of a scissor-action carrier showing its elongated first arm and its associated elongated second arm in parallel alignment.
Figure 3:
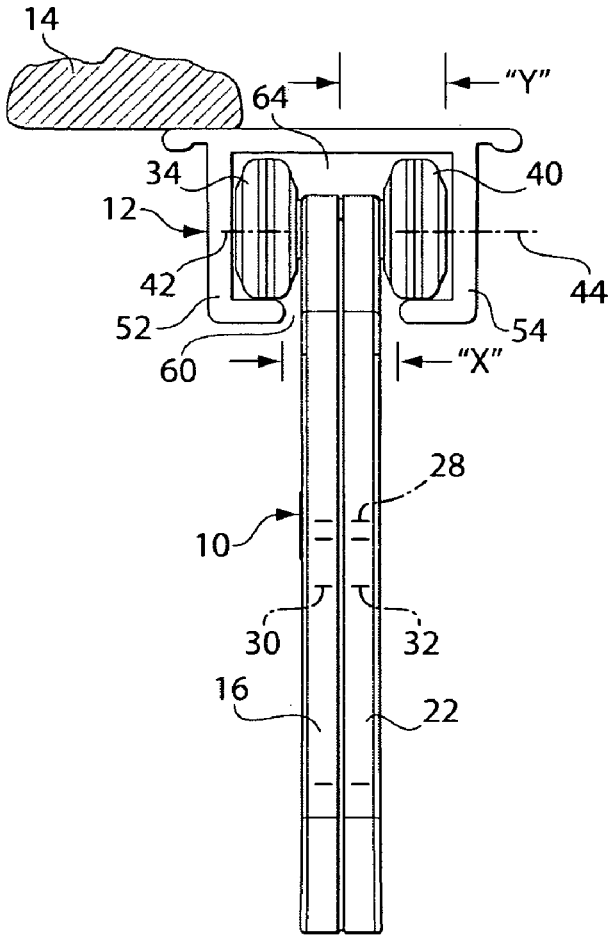
FIG. 3 is an end elevation view of a scissor-action carrier disposed within an extruded channel support track.

Referring now to the drawings in detail, and particularly to FIG. 1, there is shown the present invention comprising a scissor-action carrier 10 which is insertable into and removable from an overhead elongated track 12 (which will be shown and identified in FIGS. 3-9 hereinbelow), at any location therein, while the support track 12 is in an overhead orientation, i.e., attached to a ceiling 14, as represented in FIG. 3. The scissor-action carrier 10 comprises an elongated first arm 16 having an upper end 18 and a lower end 20, the first arm 16 connected to a "mirror image" elongated second arm 22 having a similar upper end 24 and a lower end 26. The elongated first arm 16 and the elongated second arm 22 are joined together at a pivot point in each arm, rotatable thereat about a rotation axis 28, much like a "scissor" action.

Figure 2:
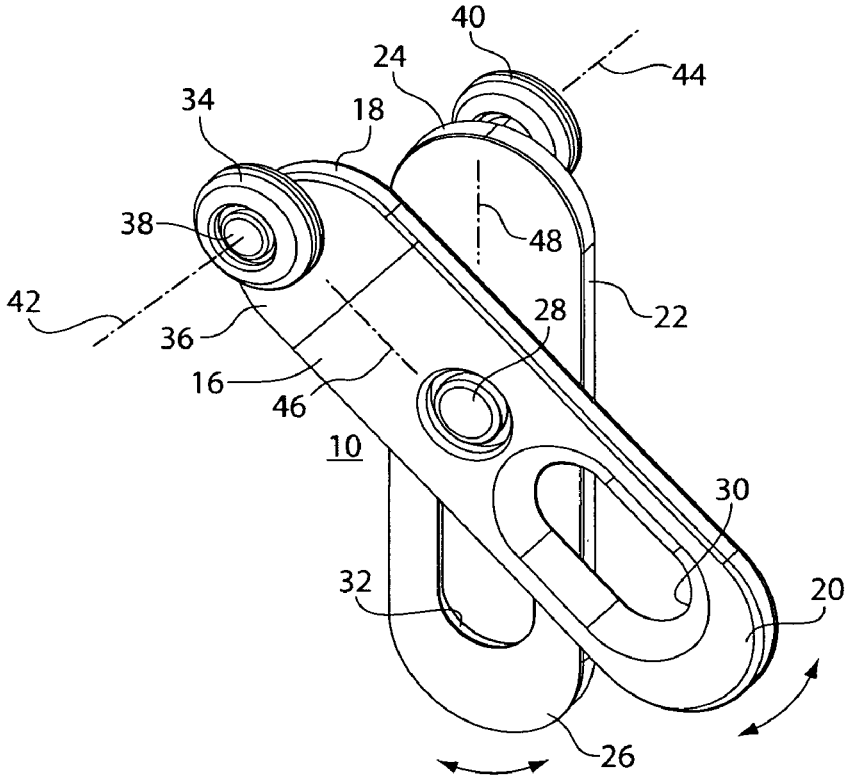
FIG. 2 is a perspective view of the scissor-action carrier shown in FIG. 1 with the elongated first arm rotated out of parallel alignment about their common rotation axis.

The elongated first arm 16 and the elongated second arm 22 each have an elongated hanger opening 30 and 32, respectively, disposed therethrough, as best seen in FIG. 2. The elongated first arm 16 has a first arm wheel 34 rotatively extending from an outer face 36 thereof, at its upper end 18, and attached thereto by a first wheel axis 38. The elongated second arm 22 has a second arm wheel 40 rotatively extending from its upper end 24 thereof and attached thereto by a second wheel axis, not shown for clarity of viewing.

The first arm wheel 34 has an axis of rotation 42 about its first wheel axis 38 as represented in FIG. 2. The second arm wheel 40 has axis of rotation 44, as shown in FIG. 2, about its second wheel axis. The elongated first arm 16 has a first arm longitudinal axis 46, as shown in FIG. 2. The elongated second arm 22 has a second arm longitudinal axis 48. During its supportive use in the channel 64 of an elongated support track 12, the axis of rotation 42 of the first wheel axis 38 and the axis of rotation 44 of the second wheel axis are in concentric alignment, as represented in FIGS. 1, 3 and 4, and their respective longitudinal axes 46 and 48, are parallel to one another.

The elongated support channel 12, as represented in FIG. 3, comprises an inverted generally "U" shaped extrusion which may have "L" shaped side flanges 52 and 54 in one preferred embodiment, or in another embodiment of the track 12, it may have a further open channel portion 56 for securing the elongated support channel 12 to a ceiling or suspended from an overhead support or track 14.

The elongated support channel 12, as represented in FIG. 3, typically has a downwardly facing slot 60 defined by the pair of spaced-apart, opposed "L" shaped flanges 52 and 54. Those "L" shaped flanges 52 and 54 define the elongated channel slot 60, of dimension "X". The width of an elongated arm 16 or 22 and its associated arm wheel 34 or 40 has a dimension "Y". The dimension "Y" has to be less than the dimension X, to permit the wheeled end of the first arm 16 and the second arm 22 to each be (separately) sequentially inserted within and (separately) sequentially removed from the slot 60 in the channel 64 of the elongated extrusion 12, the wheels 34 and 40 being rotatively/movably supported on the inside edges of the "L" shaped flanges 52 and 54, as represented best in FIGS. 3 and 4.

Figure 4:
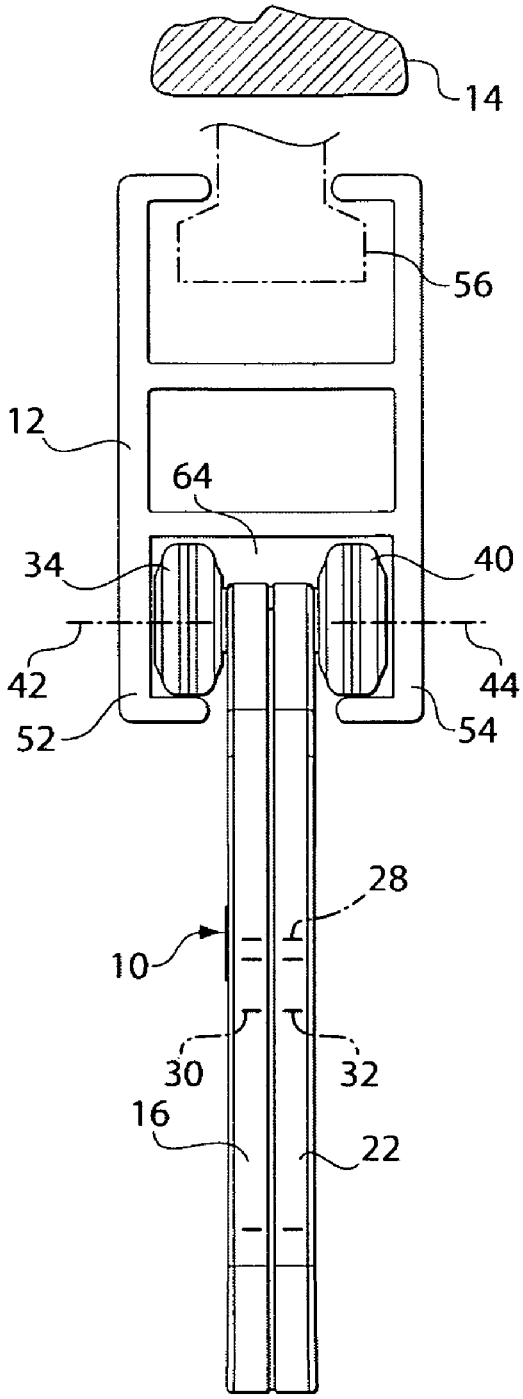
FIG. 4 is an end elevation view of a scissor-action carrier disposed within a further embodiment of an extruded channel support track.
Figure 5A:
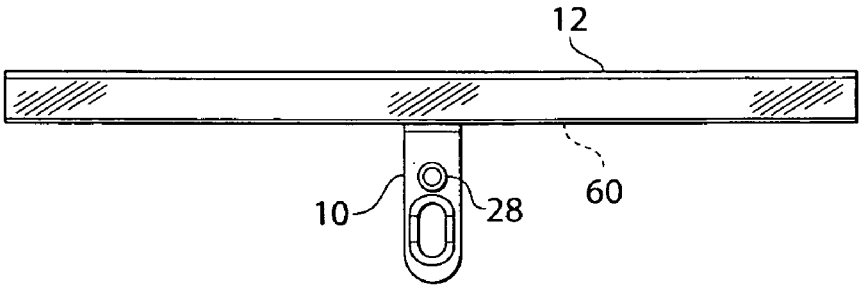
FIGS. 5A through 5E represent, in side elevational views, a scissor-action carrier arranged within an elongated channel support track, the scissor-action carrier arms being rotated about their rotation axis and twisted about their respective longitudinal axes, so as to permit the removal of the scissor-action carrier from the elongated support track.
Figure 5B:
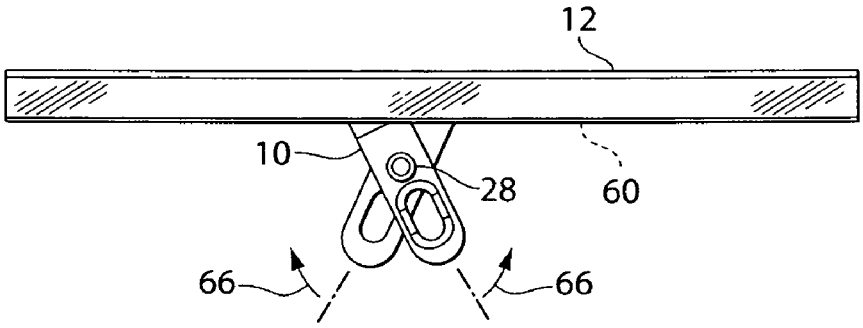
Figure 5C:
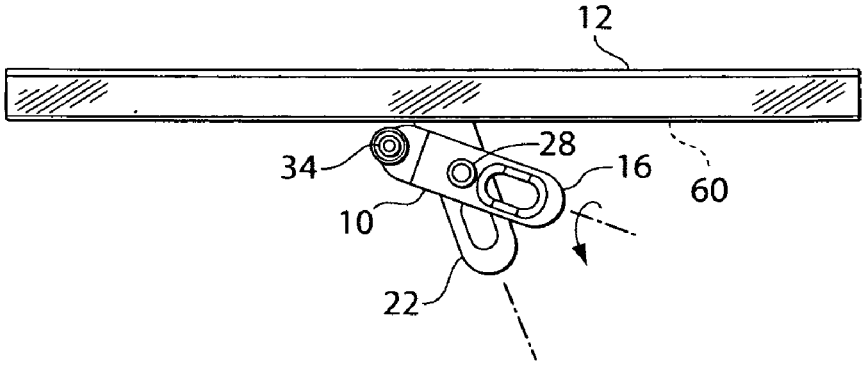
Figure 5D:
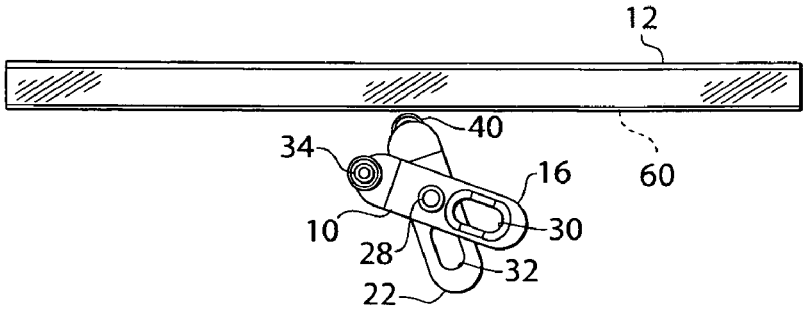
Figure 5E:
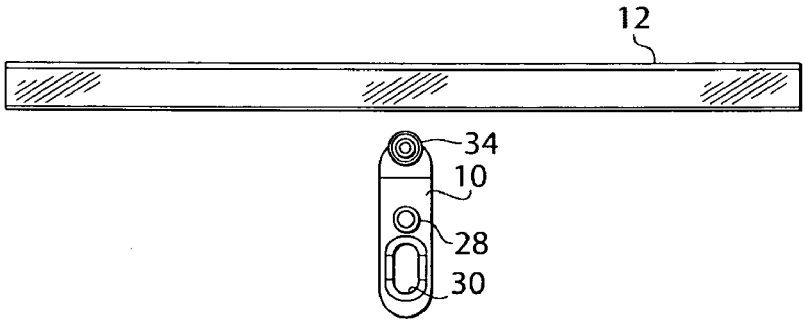
Figure 6A:
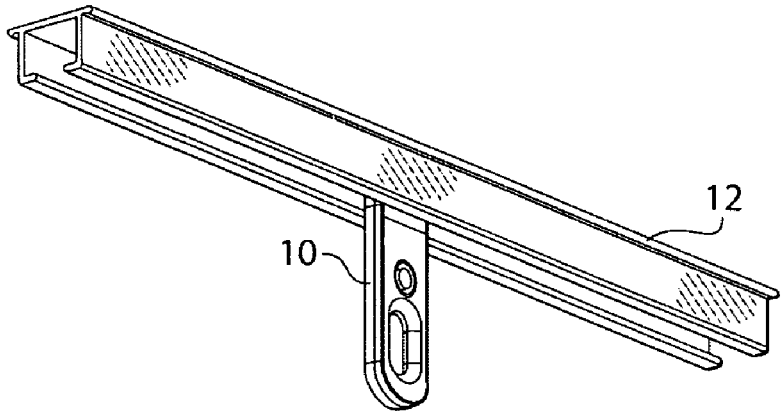
FIGS. 6A through 6D show in a perspective view the scissor-action carrier and the elongated track articulation represented in FIGS. 5A through 5E.
Figure 6B:
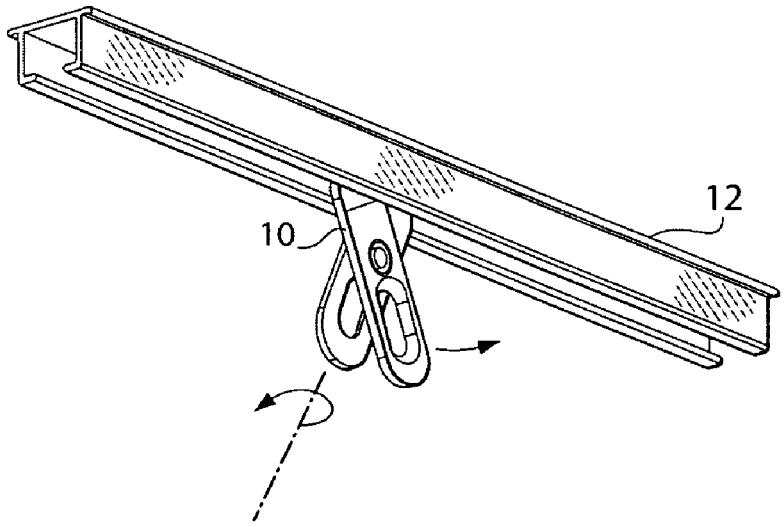
Figure 6C:
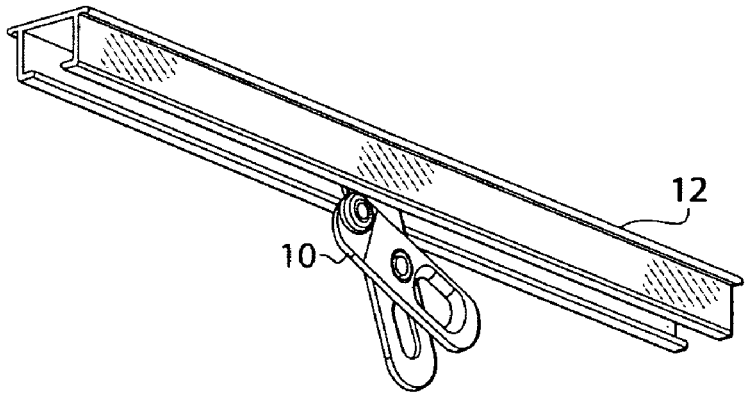
Figure 6D:
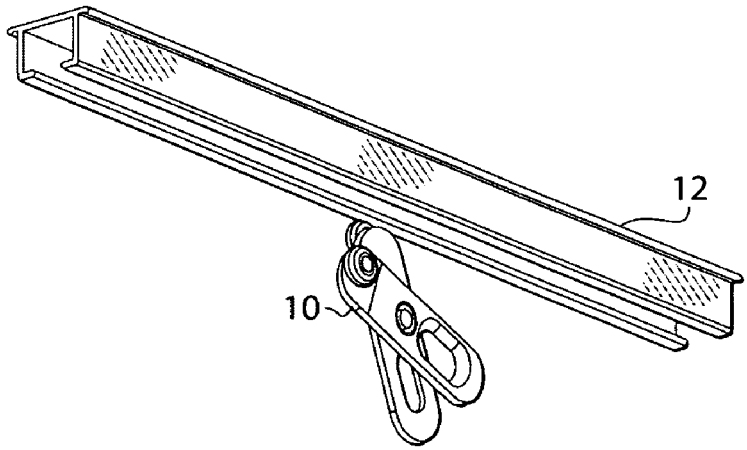
Figure 7:
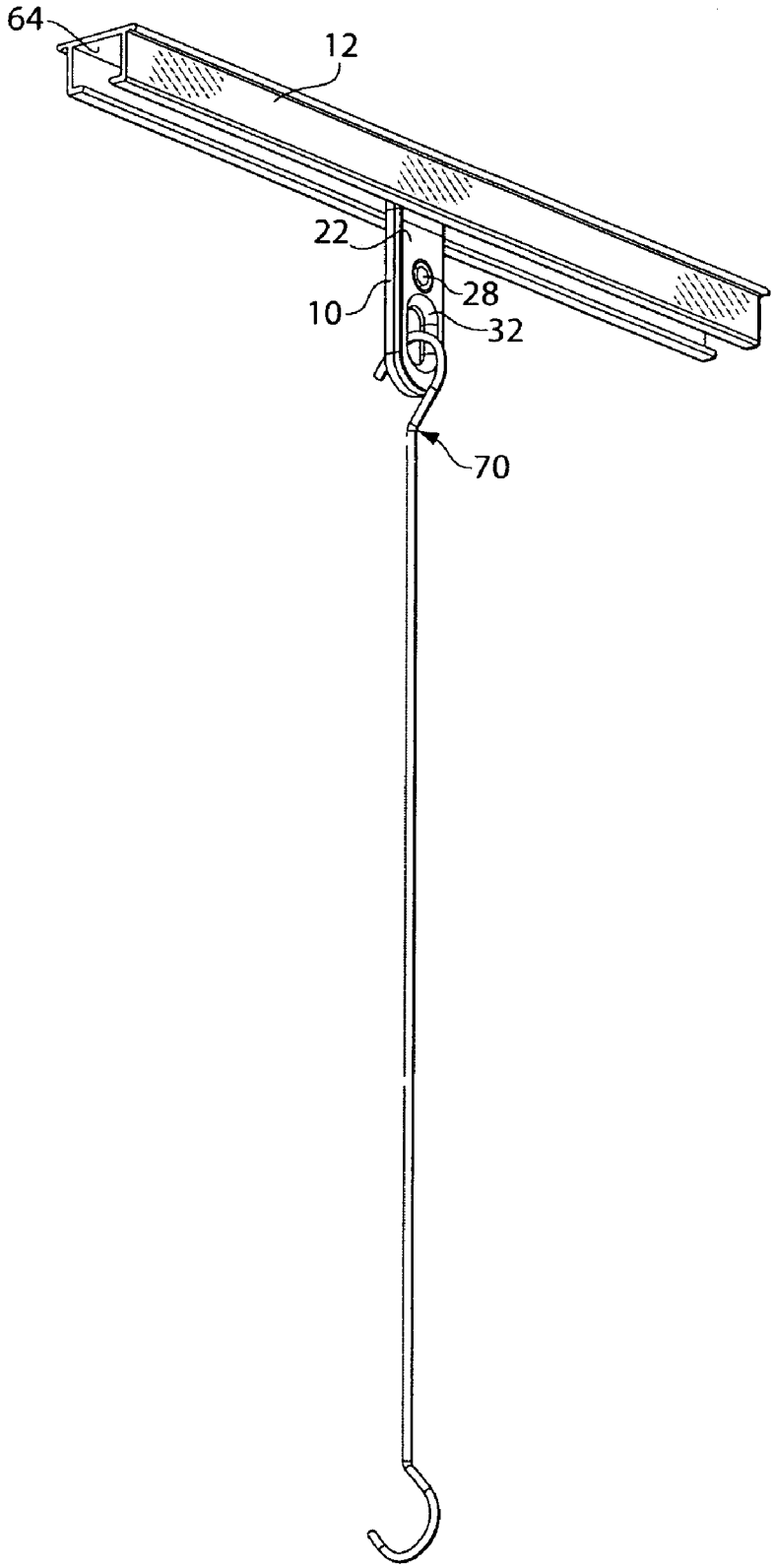
FIG. 7 shows a scissor-action carrier and an elongated support track in a perspective view having an elongated hook attached to the arm hanger opening of that scissor-action carrier in the overhead support track.
Figure 8:
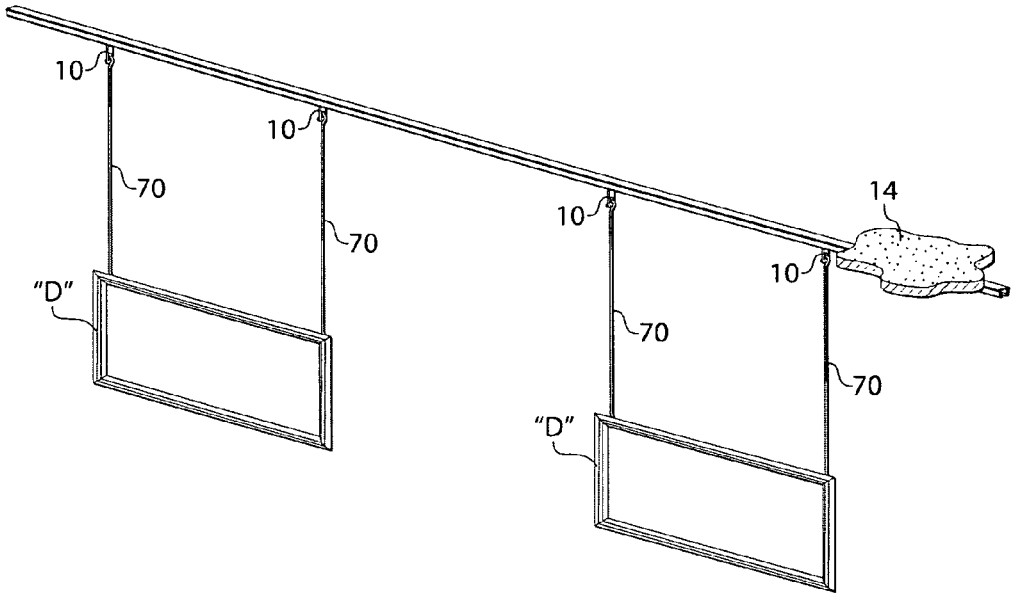
FIG. 8 shows in a perspective view a pair of display panels each supported from one elongated overhead support track by an arrangement of scissor-action carriers.
Figure 9:
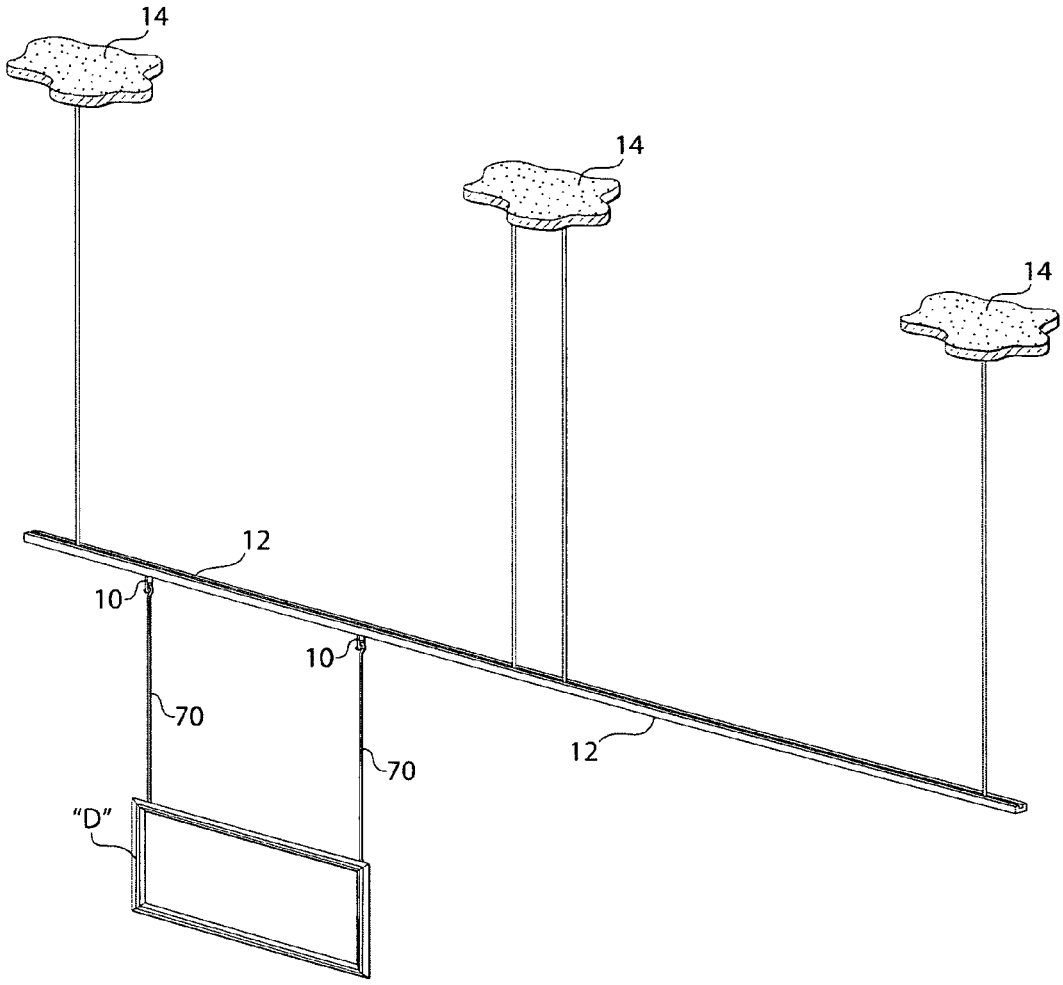
FIG. 9 shows in a perspective view, a further embodiment for the support of an elongated overhead track.

In order to insert the scissor-action carrier 10 into the inner channel 64 of an elongated extrusion 12, as represented in FIGS. 3 and 4, the elongated first arm 16 and the elongated second arm 22 have to be rotated with respect to one another about their common rotation axis 28, so as to permit the width of only one elongated arm 16 or 22 to pass through the channel slot 60, of dimension "X". The rotation of the elongated first arm 16 with respect to the elongated second arm 22 about their common rotation axis 28, is represented by arrows 66 in FIG. 5B, which permits the upper end 18 and 24 respectively, of each elongated arm 16 and 22, to be separately and sequentially inserted and/or removed through the slot 60 of the channel 64 of the elongated extrusion 12, as represented in FIGS. 5A though 5E. Such pivoting of the first arm 16 and the second arm 22 about their axis of rotation 28 is represented in perspective views in FIGS. 6A through 6D, wherein a carrier 10 has its arms 16 and 22 pivoted with respect to one another, see FIG. 6B, and one arm 16 twisted about its longitudinal axis 46 and hence removed from the slot 60, see FIG. 6C, with the second arm 22 twisted about its longitudinal axis 48 to permit its articulation.

Upon the insertion of the first arm wheel 34 and the second arm wheel 40 into the channel 64 of the elongated extrusion 12, the elongated first arm 16 and elongated second arm 22 are again rotated about their rotation axis 28 so as to bring the first arm wheel axis 42 and the second arm wheel axis 44 into longitudinal alignment with one another, as shown in FIGS. 1, 3, 4, 5A, 6A, and 7. Correspondingly, the first arm hanger opening 30 and the second arm hanger opening 32 also come into face-to-face alignment with one another, as best represented in FIGS. 1, 5A, 5E and 7, once the respective first elongated arm's longitudinal axis 46 is in parallel alignment with the second arm's longitudinal axis 48. The first arm hanger opening 30 and the second arm hanger opening 32 thus present a common (joint) opening for insertion of a hook 70, or the like from which a display panel "D" may be suspended, as represented in several ceiling link embodiments shown in FIGS. 8 and 9. When a hook 70 or the like is inserted into the openings 30 and 32 in the scissor-action carrier 10, the first arm 16 and the second arm 22 may not be rotated with respect to one another, this ensuring that the scissor-action carrier 10 will not be unintentionally removed from the channel 64 of the elongated extrusion 12 until the hook 70 or the like has been removed therefrom.

It is to be noted that such an insertion process of the scissor-action carrier 10 may take place at any location along the length of the elongated extrusion track 12. Similarly, the removal of the scissor-action carrier 10 may take place at any location along the length of the extrusion track 12 by reversing the process of the insertion of the scissor-action carrier 10. That is, the first elongated arm 16 is rotated with respect to the elongated second arm 22 about their common rotation axis 28 so as to separate the co-alignment of the first wheel 34 and the second wheel 40, so as to minimize the thickness of the scissor-action carrier 10 at its upper end, thus permitting each wheel's individual removal from the slot 60 of the elongated track 12.

The invention claimed is:

1. A carrier for suspending a display from an overhead support track, comprising:

an elongated first arm and an elongated second arm pivotally connected to one another at a pivot axis in a scissor-like relationship, wherein the first arm and the second arm are arrangeable from an arm-skewed, track-insertable orientation into a first and second arm parallel, support-track engagingly-secured, sign bearing orientation.

2. The carrier as recited in claim 1, wherein the overhead support track comprises an inverted "U" shaped channel.

3. The carrier as recited in claim 1, wherein the carrier comprises a rotatable wheel attached to an upper or first end of each elongated arm.

4. The carrier as recited in claim 3, wherein each wheel is individually insertable into and individually removable from the "U" shaped channel.

5. The carrier as recited in claim 4, wherein the carrier comprises a connector means arranged at a lower end of each arm to permit support of a display therefrom when the connector means and the rotatable wheel of each arm are in respective alignment with one another.

6. The carrier as recited in claim 5, wherein the connector means comprises a support-receiving opening on the lower end of each arm.

7. The carrier as recited in claim 6, wherein the arms are locked into the support track in a non-removable orientation when a support connector is received through the support receiving openings.

8. The carrier as recited in claim 6, wherein the rotatable wheels on the upper end of each arm are in longitudinal alignment with one another when the support-receiving openings are in face to face alignment with one another.

9. The carrier as recited in claim 6, wherein each of the rotatable wheels on the upper end of each arm are mounted on an independent wheel axis to permit each wheel to be independently loaded into and independently removed from the support track.

10. A method of supporting a display from an overhead support channel attached to a ceiling, comprising:

inserting an upper wheeled end of a first arm of scissor-action carrier into a slot of the overhead support channel;

inserting an upper wheeled end of a second arm of a scissor-action carrier into the slot of the overhead support channel, independent of the first arm;

pivoting the first arm and the second arm of the scissor-action carrier into parallel alignment with one another, for wheeled engagement of the scissor-action within the overhead support channel; and attaching a display to the lower end of the aligned arms of the scissor-action carrier.

11. The method as recited in claim 10, including:

locking the first arm and the second arm into parallel alignment with one another when a display is supported from the lower end of the arms, to prevent free rotation of the arms of the carrier and preventing unintentional disengagement from the support track.

12. A method of supporting a display from an overhead support channel attached to a ceiling, comprising:

pivoting a pair of scissor-like connected arms out of an aligned relationship with one another into a skewed non-aligned relationship with one another;

inserting each wheel arranged on an upper end of each of the arms, individually into the overhead support channel;

pivoting the connected arms into an aligned relationship with one another; and attaching a display support to a lower end of the arm to lock the arms together and prevent the arms from rotation and thus prevent their unintended removal from the overhead support channel.

13. The method as recited in claim 12, including:

forming an opening in the lower end of each of the arms to permit insertion of the display support through both lower end of the arms.

14. The method as recited in claim 12, including:

removing the display support from the openings in the lower end of each arm to permit the arms to be rotated out of parallel alignment with one another, thus permitting the connected arms to be removed from the overhead channel.

15. The method as recited in claim 12, including:

individually inserting and individually removing each wheel from the overhead channel, to permit the carrier to be supported from the overhead channel and to permit the carrier to be removed from the overhead channel.

16. The method as recited in claim 12, including:

aligning the first arm parallel to the second arm to lock the carrier in movable support relationship in the support channel.

* * * * *